United States Patent [19]

Shibue et al.

[11] 4,255,515

[45] Mar. 10, 1981

[54] PHOTOGRAPHIC FILMS

[75] Inventors: Toshiaki Shibue; Koichi Nagayasu; Masayoshi Mayama; Masao Ishihara; Naoto Abe, all of Hino, Japan

[73] Assignee: Konishiroku Photo Industry Co., Ltd., Tokyo, Japan

[21] Appl. No.: 959,592

[22] Filed: Nov. 13, 1978

[30] Foreign Application Priority Data

Nov. 19, 1977 [JP] Japan ..... 52-139246

[51] Int. Cl.[3] ..... G03C 1/78

[52] U.S. Cl. ..... 430/495; 430/527; 430/531; 430/533; 430/961

[58] Field of Search ..... 96/87 A, 50 PL, 67; 430/527, 531, 533, 529, 495, 961

[56] References Cited

U.S. PATENT DOCUMENTS

| | | | |
|---|---|---|---|
| 2,391,181 | 12/1945 | Minsk et al. | 96/87 A |
| 3,222,178 | 12/1965 | Nadeau et al. | 96/87 A |
| 3,525,621 | 8/1970 | Miller | 96/87 A |
| 4,050,934 | 9/1977 | Turner | 96/1.5 |

*Primary Examiner*—Won H. Louie, Jr.

*Attorney, Agent, or Firm*—Frishauf, Holtz, Goodman & Woodward

[57] ABSTRACT

A photographic film which comprises (A) a support, having two sides, (B) at least one light-sensitive emulsion layer on one side of said support (A), and, (C) at least one layer containing a compound represented by formula [I]and a hydrophobic polymer (first layer) and at least one layer containing an antistatic agent (second layer), said first and second layers being placed on the other side of said support (A) and said first layer being placed closer to said support (A) than said second layer:

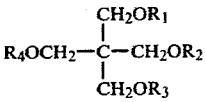

[I]

wherein, $R_1$ represents a carboxylic acid residue having from 12 to 24 carbon atoms and $R_2$, $R_3$ and $R_4$ represent independently hydrogen atoms or organic acid residues having from 1 to 24 carbon atoms.

13 Claims, No Drawings

PHOTOGRAPHIC FILMS

The invention relates to light-sensitive photographic materials. More particularly, it relates to photographic films having antistatic reverse side layer with which the scratch-proof property of the film has been improved.

A scratch mark may sometimes be generated on the surface of photographic films, during exposing or treating of films such as processing and printing, by the contact or friction of films with apparatuses. The scratch mark tends to be generated on the reverse side of films which may readily come into contact with apparatuses and become severe cause of practical troubles upon printing and projection.

Scratch marks may be generated during not only treating steps but also manufacturing steps of films. Currently, it is required to accelerate manufacturing and processing steps, and hence, it is desired to obtain photographic films having scratch-proof reverse side layers which can meet the requirement of the acceleration.

Heretofore, various attempts have been made to improve the scratch-proof property of the reverse side layer of photographic films. For example, a measure to improve the scratch-proof property not only by increasing the mechanical strength of the reverse side layer of photographic films but also by decreasing the sliding friction of the reverse side layer has been proposed. However, known photographic films containing a lubricant within the reverse side layer lose most of or a part of the lubricant during processing and lose the effect. This is significant when an antistatic agent is dissolved during processing. Consequently, scratch marks tend to be generated during subsequent processing.

If too much of a lubricant is contained within the reverse side layer, allowing for the loss of it, it will cause film transfer trouble during manufacture called "overslipping trouble." Namely, known photographic films having a slipping reverse side layer may maintain the necessary slipping property and improve the scratch-proof property for the period from the manufacture to some step of use.

However, they can not maintain the necessary slipping property before and after processing, unless there is provided a measure, for example, to process them with a bath containing a lubricant during processing.

It is, therefore, an object of the invention to provide photographic films having an antistatic reverse side layer which may exhibit an excellent scratch-proof property before and after processing.

It is another object of the invention to provide photographic films having the same or different slipping property before and after processing so as to be suitable for respective processes and operations.

It is still another object of the invention to provide photographic films having reverse side layers capable of maintaining a sufficient slipping property before and after processing, even if there is no treatment thereof with a bath containing a lubricant at the time of processing.

The inventors have found, after extensive investigations, that the objects of the invention may be attained, in photographic films having a light-sensitive emulsion layer on one side of a support and other layers on the reverse side, by providing, as the reverse side layers, (1) at least one layer comprising a compound represented by the following formula (I) and a hydrophobic polymer (first layer), and, (2) at least one layer comprising an antistatic agent (second layer), such that the first layer is located closer to the support than the second layer:

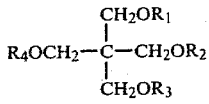

[I].

In the above formula [I], $R_1$ represents a carboxylic acid residue having from 12 to 24 carbon atoms, and $R_2$, $R_3$ and $R_4$ represent independently hydrogen atoms or organic acid residues having from 1 to 24 carbon atoms.

As the carboxylic acid residue having from 12 to 24 carbon atoms represented by $R_1$ are mentioned, for example, residues derived from saturated monocarboxylic acids such as lauric acid, palmitic acid and stearic acid, unsaturated monocarboxylic acids such as oleic acid, linolenic acid and linoleic acid, aromatic carboxylic acids such as benzoic acid, naphthalenecarboxylic acid and phthalic acid, and carboxylic acids in which hydrogen atom of the above-mentioned carboxylic acid may substituted with a hydroxy group or a halogen atom such as fluorine, chlorine and bromine. As the organic acid residues having from 1 to 24 carbon atoms represented by $R_2$, $R_3$ and $R_4$ are mentioned, for example, carboxylic acid residues represented by $R_1$, and ketocarboxylic acid residues derived from acetoacetic acid, p-acetylbenzoic acid, benzoylacetic acid, or the like.

Among the compounds of formula [I] to be used in the invention, those in which $R_2$ and $R_3$ are straight chain carboxylic acid residues having from 12 to 24 carbon atoms are preferable. More preferable are those, in addition to above, in which $R_4$ is a straight chain carboxylic acid residue having from 12 to 24 carbon atoms.

Compounds of formula [I] to be used in the invention may be employed alone or together.

Representative examples of compounds of formula [I] to be used in the invention include:

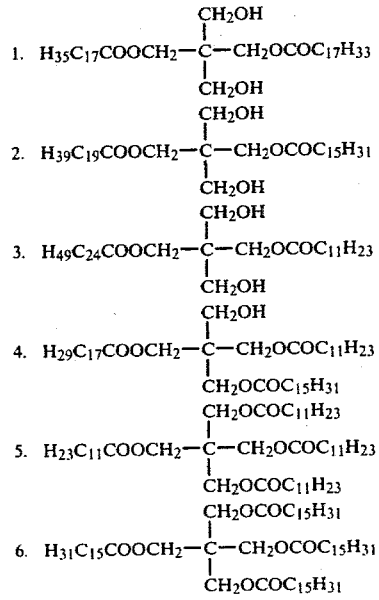

-continued

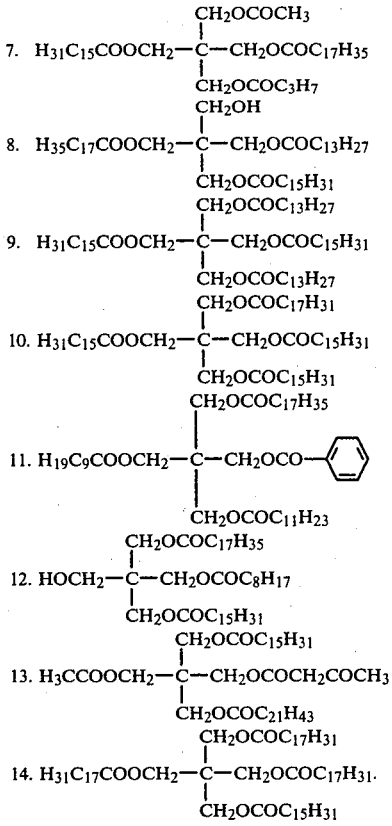

Examples of preparation of compounds represented by formula [I] are given below.

Preparation 1

(Illustrated Compound No. 1)

Into a 200 ml. round bottom, short neck flask fitted with an esterification tube and a cooler were placed 3.4 g. of pentaerythritol, 14.2 g. of stearic acid, 0.5 g. of p-toluenesulfonic acid and 100 ml. of toluene. The transesterification was performed by refluxing the mixture at about 120° C. of external temperature, while removing water formed in situ.

After completion of removal of the water, the reaction mixture was cooled and washed several times in a separating funnel with water to remove the p-toluenesulfonic acid. A waxy substance thus obtained was washed several times with methanol to remove the unreacted materials, giving the desired product, pentaerythritol distearate. The results of elementary and NMR analyses revealed that the substance had the desired structure.

Preparation 2

(Illustrated Compound No. 6)

Into a 300 ml. round bottom, short neck flask fitted with an esterification tube and a cooler were placed 6.8 g. of pentaerythritol, 64.1 g. of palmitic acid, 1.0 g. of p-toluenesulfonic acid and 150 g. of toluene. The transesterification was performed by refluxing the mixture at about 130° C. of external temperature, while removing water formed in situ.

After completion of removal of the water, the reaction mixture was washed several times in a separating funnel with water to remove the p-toluenesulfonic acid. A waxy substance thus obtained was purified to give the desired pentaerythritol tetrapalmitate, which was confirmed to have an aimed structure by elementary and NMR analyses.

Preparation 3

(Illustrated Compound No. 9)

Into a 200 ml. round bottom, short neck flask fitted with an esterification tube and a cooler were placed 3.4 g. of pentaerythritol, 16.0 g. of palmitic acid, 14.2 g. of myristic acid, 0.5 g. of p-toluenesulfonic acid and 100 ml. of benzene. The transesterification was performed by refluxing the mixture at about 110° C. of external temperature, while removing water formed in situ. After completion of removal of the water, the reaction mixture was cooled and washed several times in a separating funnel with water to remove the p-toluenesulfonic acid. A waxy substance thus obtained was washed several times with methanol to remove the unreacted materials, giving the aimed pentaerythritol dipalmitate dimyristate. The chemical structure of the substance was confirmed by elementary and NMR analyses.

Hydrophobic polymers to be used in the invention may be coated and dried in the form of a solution or dispersion. They are preferably those which are insoluble in an acidic, alkaline or neutral solution such as processing baths (e.g. developing or fixing solution or washing water etc.). As the hydrophobic polymer used in the invention are mentioned, for example, cellulose derivatives such as cellulose diacetate, cellulose triacetate, cellulose acetate butylate, cellulose nitrate and ethylcellulose; polyvinyl acetals; vinyl chloride/vinylidene chloride copolymers; vinyl chloride/acrylonitrile copolymers; acrylic acid ester/vinyl chloride/vinyl acetate copolymers; vinylidene chloride/methyl acrylate/acrylic acid copolymers; or the like. Thereof, preferable for the hydrophobic polymers are cellulose derivatives, inter alia, cellulose diacetate.

In order to provide a layer comprising a compound of formula [I] of the invention and a hydrophobic polymer (hereinafter referred to as first layer), a compound of formula [I] and a hydrophobic polymer are dissolved in a suitable solvent to make a coating solution, which is coated on a support and dried by a conventional method.

The concentration of the compound of formula [I] ranges preferably from 0.01 to 1 g., more preferably from 0.05 to 0.4 g. per 100 ml. of the solvent. The mixing ratio of the hydrophobic polymer to the compound of formula [I] ranges preferably from ½ to 4, more preferably from 1 to 2 by weight, based on one part of the compound of formula [I].

The amount of the compound of formula [I] to be coated is from 3 to 300 mg./m$^2$ of a photographic film.

As the solvent to be used, there is no specific limitation as to the nature and are mentioned, for example, acetone, ethyl acetate, methylene chloride, ethylene dichloride, trichloroethylene, benzene, or the like. They may be optionally selected and used alone or together.

The coating solution may be coated on a support by a conventional method such as dip-coating, roller-coating and spray-coating and thereafter dried by a usual method.

The first layer may further contain various additives such as matting agent which may be necessary depending on the usage of photographic films.

As the antistatic agent to be used in the invention, those which provide a good electroconductivity and have a superior film-coating property by themselves, or when used in combination with a suitable binder, such as a polymer electrolyte are effectively used.

Examples of such antistatic agents may be copolymerization salts of styrene with styreneundecanoic acid, disclosed in U.S. Pat. No. 3,333,679; maleic acid or maleinimide resins, disclosed in U.S. Pat. No. 2,279,410; alkali metal salts of alkylarylpolyether sulfonic acids and of carboxylic acid polymers, disclosed in U.S. Pat. No. 3,525,621; alkali metal salts of polycarboxylic acids, disclosed in U.S. Pat. No. 3,630,742; polystyrenesulfonic acids, disclosed in U.S. Pat. No. 2,735,841; quaternary salts of polyvinylpyridine, disclosed in U.S. Pat. Nos. 2,787,834 and 3,072,484; polyquaternary alkylaminoacrylate, disclosed in U.S. Pat. No. 2,882,152; anionic polymer of maleic acid derivative, ionen type polymer, copolymer of a pendant type quarternary ammonium salt monomer and a hydrophobic monomer, copolymer of a pendant type quarternary ammonium salt monomer and a monomer containing fluorine disclosed in Japanese Patent Publication Specification Nos. 46-24159, 50-54672 and 50-94053, as laid open to public inspection, and Japanese Patent Application Specification No. 51-45458 respectively. Thereof, those disclosed in Japanese Patent Publication Specification Nos. 46-29159, 50-54672 and 50-94053, as laid open to public inspection, and Japanese Patent Application Specification No. 51-45458 are advantageously employed. It is preferable that a layer containing an antistatic agent of the invention (hereinafter referred to as second layer) is provided adjacent to and upper side of the aforementioned first layer.

In order to attain this an antistatic agent is dissolved in a suitable solvent to make a solution, and where required, it is jointly used with a binder to make a coating solution, which is coated and dried on the surface of the first layer on the support. As the solvent for the antistatic agent, there may be employed methanol, ethanol and acetone, besides water, and they may be employed together. The coating solution may be coated on the first layer of the support by a conventional method such as dip-coating, roller-coating and spray-coating, and thereafter dried according to a usual method.

There is no specific limitation as to concentration of the antistatic agent in the coating solution; but it is preferable from the viewpoints of easiness of coating and drying that the antistatic agent is contained in an amount of from 0.01 to 10% by weight. The amount of antistatic agent to be coated is from 3 to 300 mg. per square meter, in general, of a photographic film, by which a satisfactory antistatic effect may be obtained. As previously mentioned, any solvent composition may be used for the coating solution of the second layer.

However, if the solvent system permeates the first layer excessively, it will impair the transparency after the coating of second layer. In order to avoid this, more than 5%, preferably from 10 to 30% of water is contained in the solvent. When more water is used, the resulting coating solution may be coated together with a coating aid such as surface active agent. The compound of formula [I] within the first layer may be dissolved, depending on the amount thereof contained, to affect the slipped property of the second layer, therefore in this case a slipping agent or an antislipping agent may be added into the second layer so as to adjust the slipping property of the second layer. The slipping property may also be adjusted by changing the solvent composition, particularly by changing the amount of water in the coating solution of the second layer. The second layer may contain a matting agent like silicon dioxide, depending on the usage. There may be further provided various layers on the second layer such as a slipping layer, a matting layer containing silicon dioxide particles, or a layer containing an anionic material or other organic compounds. The scratch-proof property of films thus obtained has been improved and the electrification caused by friction or exfoliation may be prevented. Moreover, degradation of photographic characteristics such as reduction of sensitivity, increase of fog and change of gamma value may also be prevented.

The present invention may be applied to any support for a photographic material. Examples of the support is a cellulosetriacetate, polyethyleneterephthalate film or luminate paper coated with polycarbonate, polystyrene, polyolefin or polyethylene.

A light-sensitive emulsion layer contains silver halide light-sensitive photographic emulsion.

The invention is further explained by the following examples which by no means restrict the scope of the invention.

EXAMPLE 1

On the surface of a cellulose acetate film was coated a solution (A) consisting of 4 g. of cellulose diacetate, 3 g. of illustrated compound No. 2, 400 ml. of acetone, 300 ml. of methylene chloride and 300 ml. of ethyl acetate in an amount of 30 ml./m$^2$ and dried to have the first layer. Thereon, was coated a solution (B) consisting of 3 g of styrene/maleic acid p-aminobenzoic acid sodium salt copolymer, 0.1 g. of sodium cetylsulfate, 650 ml. of methanol, 250 ml. of acetone and 100 ml. of water in an amount of 20 ml./m$^2$ and dried to form the second layer, thus giving a cellulose triacetate film having the first and second layers and bearing adequate slipping and antistatic properties. Then, the other side of the film was undercoated to form a subbing layer, upon which a silver halide emulsion was coated and dried to give a photographic film [I] according to the invention. The results of a series of actual performance, namely exposing with a camera, processing and printing revealed that almost neither static marks nor scratch marks were observed on a print and that no degradation of photographic characteristics was observed as well.

For comparison, a photographic film [II] was obtained by coating a solution (C) containing none of the above-mentioned compound No. 2, in place of solution (A), in an amount of 30 ml./m$^2$, as well as a photographic film [III] containing the second layer only were prepared and processed in the same way as in the photographic film [I]. A photographic film [IV] was obtained in the same way as the film [I] except only that the first layer and the second layer were exchanged. A considerable number of scratch marks were observed on prints obtained from the photographic films [II], [III] and [IV].

The values of static friction coefficient ($\mu s$) and kinetic friction coefficient ($\mu k$) of the specimens against a styrene/butadiene board are shown in Table 1.

TABLE 1

| Film | | $\mu s$ | $\mu k$ |
|---|---|---|---|
| Film [I] | before processing | 0.45 | 0.38 |
| | after processing | 0.34 | 0.28 |
| Film [II] | before processing | 0.48 | 0.42 |

TABLE 1-continued

| Film | | μs | μk |
|---|---|---|---|
| | after processing | 0.46 | 0.45 |
| Film [III] | before processing | 0.42 | 0.43 |
| | after processing | 0.46 | 0.44 |
| Film [IV] | before processing | 0.32 | 0.27 |
| | after processing | 0.45 | 0.44 |

EXAMPLE 2

On the surface of a biaxially stretched, crystallized polyethylene terephthalate was coated a solution (D) having the following composition in an amount of 20 ml./m$^2$ and dried to having the first layer:

| | |
|---|---|
| Cellulose triacetate | 3 g. |
| tertiary copolymer consisting of vinylidene chloride, methyl acrylate and acrylic acid (65:35:2, by weight) | 1 g. |
| illustrated compound No. 8 | 1.5 g. |
| ethylene dichloride | 650 ml. |
| methylene dichloride | 200 ml. |
| phenol | 150 ml. |

Thereon, was coated solution (E) having the following composition in an amount of 20 ml./m$^2$ and dried, forming the second layer:

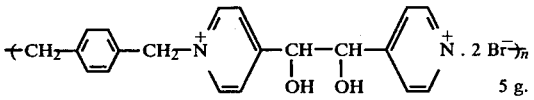

| | |
|---|---|
| | 5 g. |
| resorcinol | 50 g. |
| methanol | 300 ml. |
| acetone | 500 ml. |
| water | 200 ml. |

The reverse side of the film was undercoated to make a subbing layer, upon which a silver halide emulsion was coated and dried, giving a photographic film [V] according to the invention.

The results of a series of actual performance, namely photographing with a camera, developing and printing revealed that almost neither static marks nor scratch marks were observed on a print and that no degradation of photographic characteristics was observed as well.

For comparison, a photographic film [VI] having a biaxially stretched, crystallized polyethylene terephthalate film was obtained by coating and drying a solution (F) containing no above-mentioned illustrated compound No. 8, in place of solution (D), in an amount of 20 ml./m$^2$, as well as a photographic film [VII] having containing the second layer only were prepared and processed in the same way as in the photographic film [V]. Considerable number of scratch marks were observed on prints obtained from the photographic films [VI] and [VII].

The values of μs and μk of the specimens against a styrene/butadiene board are indicated in Table 2.

TABLE 2.

| Film | | μs | μk |
|---|---|---|---|
| Film [V] | before processing | 0.45 | 0.48 |
| | after processing | 0.31 | 0.32 |
| Film [VI] | before processing | 0.47 | 0.42 |
| | after processing | 0.44 | 0.45 |
| Film [VII] | before processing | 0.42 | 0.38 |

TABLE 2.-continued

| Film | | μs | μk |
|---|---|---|---|
| | after processing | 0.43 | 0.46 |

EXAMPLE 3

On a surface of a cellulose triacetate film was coated a solution (G) having the following composition in an amount of 20 ml./m$^2$ and dried:

| | |
|---|---|
| cellulose diacetate | 3 g. |
| illustrated compound No. 9 | 2 g. |
| silicon dioxide particles | 1 g. |
| acetone | 550 ml. |
| ethylene dichloride | 250 ml. |
| methylene dichloride | 200 ml. |

Thereon, was coated a solution (H) having the following composition in an amount of 20 ml./m$^2$ and dried, forming the second layer and giving an antistatic triacetate film having the first and second layers:

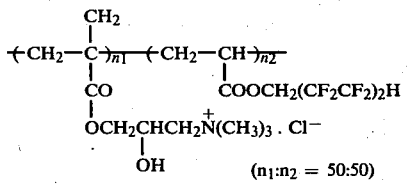

| | |
|---|---|
| | 1 g. |
| triethylamine salt of stearylphosphoric acid acidic ester | 0.1 g. |
| acetone | 500 ml. |
| methanol | 250 ml. |
| water | 350 ml. |

The reverse side of the film was undercoated to make a subbing layer, upon which a silver halide emulsion was further coated and dried, giving a photographic film [VIII] according to the invention.

The results of a series of actual performance, namely photographing with a camera, developing and printing revealed that almost neither static marks nor scratches were observed on a print and that no degradation of photographic characteristics was observed as well.

For comparison, a photographic film [IX] was obtained by coating and drying a solution (H) containing no above-mentioned compound No. 9, in place of dispersion (G), in an amount of 20 ml./m$^2$. While a photographic film [X] containing the second layer only were prepared and processed in the same way as in the photographic film [VIII]. Considerable number of scratch marks were observed on prints obtained from the photographic films [IX] and [X].

The values of μs and μk of the specimens against a styrene/butadiene board are indicated in Table 3.

TABLE 3.

| Film | | μs | μk |
|---|---|---|---|
| Film [VIII] | before processing | 0.31 | 0.32 |
| | after processing | 0.35 | 0.30 |
| Film [IX] | before processing | 0.43 | 0.42 |
| | after processing | 0.47 | 0.45 |
| Film [X] | before processing | 0.37 | 0.35 |
| | after processing | 0.96 | 0.45 |

EXAMPLE 4

On a surface of a cellulose triacetate film was coated a solution (I) having the following composition in an amount of 20 ml./m$^2$ and dried:

| | |
|---|---|
| cellulose diacetate | 2 g. |
| illustrated compound No. 13 | 2 g. |
| acetone | 400 ml. |
| methylenchloride | 300 ml. |
| methanol | 300 ml. |

Then the following solution (J) was coated on in an amount of 20 ml./m$^2$ and dried:

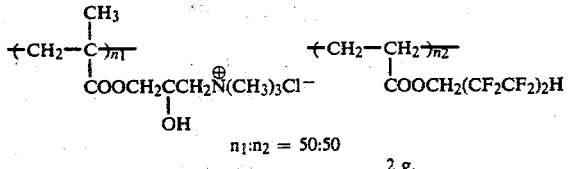

$n_1:n_2 = 50:50$

| | |
|---|---|
| | 2 g. |
| methanol | 650 ml. |
| acetone | 200 ml. |
| water | 150 ml. |

The reverse side of the film was undercoated to make a subbing layer, on which a silver halide emulsion was further coated and dried to obtain a photographic film [X] according to this invention.

For comparison, a photographic film [XI] was obtained in the same manner except that coating the solutions (I) and (J) were replaced to a coating solution having the following composition (K):

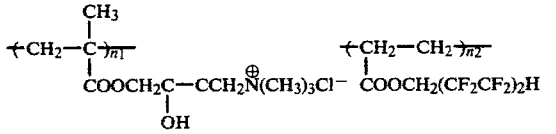

| | |
|---|---|
| | 2 g. |
| cellulose diacetate | 2 g. |
| illustrated compound No. 13 | 2 g. |
| acetone | 400 ml. |
| methylenchloride | 300 ml. |
| methanol | 300 ml. |

It was coated in an amount of 20 ml./m$^2$.

Both films were processed in the same way as in Example 1. Considerable number of scratch marks were observed on a print obtained from the photographic film [XI].

The values of $\mu s$ and $\mu k$ of the photographic films against a styrene/butadiene board are shown in Table 4.

TABLE 4.

| Film | | $\mu s$ | $\mu k$ |
|---|---|---|---|
| Film [XI] | before processing | 0.38 | 0.37 |
| | after processing | 0.30 | 0.26 |
| Film [XII] | before processing | 0.31 | 0.29 |
| | after processing | 0.47 | 0.46 |

We claim:

1. A photographic film which comprises (A) a support having two sides, (B) at least one light-sensitive silver halide emulsion layer on one side of said support (A), and, (C), at least one layer containing a compound represented by formula I and a hydrophobic polymer (first layer) and at least one layer containing an antistatic agent (second layer), said first and second layers being placed on the other side of said support (A) and said first layer being placed closer to said support (A) than said second layer:

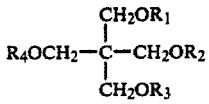

formula I wherein, $R_1$ represents a carboxylic acid residue having from 12 to 24 carbon atoms and $R_2$, $R_3$ and $R_4$ represent independently hydrogen atoms or organic acid residues having from 1 to 24 carbon atoms.

2. The photographic film as claimed in claim 1, wherein $R_1$, $R_2$ and $R_3$ are straight chain carboxylic acid residues having from 12 to 24 carbon atoms.

3. The photographic film as claimed in claim 2, wherein $R_4$ is a straight chain carboxylic acid residue having from 12 to 24 carbon atoms.

4. The photographic film as claimed in claim 1, in which the compound having formula (I) is selected from the group consisting of:

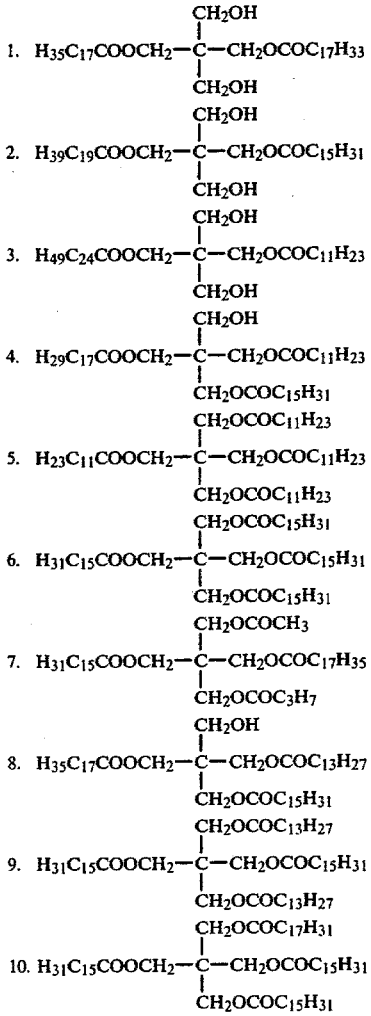

-continued

11. 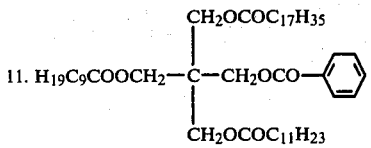

12. 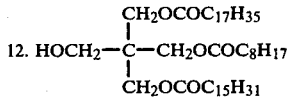

13. 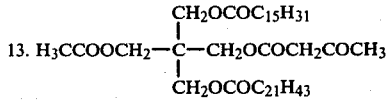

14. 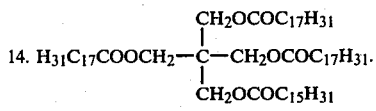

5. The photographic film as claimed in claim 1 or 2, wherein the hydrophobic polymer is a cellulose derivative.

6. The photographic film as claimed in claim 1 or 4, wherein the hydrophobic polymer is cellulose diacetate.

7. The photographic film as claimed in claim 1, wherein the antistatic agent is a high molecular electrolyte.

8. The photographic film as claimed in claim 1 or 4, wherein the second layer is formed by using a coating solvent which dissolves substantially none of the first layer.

9. The photographic film as claimed in claim 6, wherein $R_4$ is a straight chain carboxylic acid residue having from 12 to 24 carbon atoms.

10. The photographic film as claimed in claim 8, wherein $R_4$ is a straight chain carboxylic acid residue having from 12 to 24 carbon atoms.

11. The photographic film as claimed in claim 9, wherein the antistatic agent is a high molecular electrolyte.

12. The photographic film as claimed in claim 10, wherein the antistatic agent is a high molecular electrolyte.

13. The photographic film as claimed in claim 10, wherein the hydrophobic polymer is cellulose diacetate.

* * * * *